US008052144B2

(12) United States Patent
Kaneko et al.

(10) Patent No.: US 8,052,144 B2
(45) Date of Patent: Nov. 8, 2011

(54) METHOD, APPARATUS, AND SYSTEM FOR FORMING IMAGE

(75) Inventors: Masaru Kaneko, Kanagawa (JP); Masami Miyajima, Kanagawa (JP); Hiroshi Aizawa, Kanagawa (JP); Kohtaroh Yonenaga, Kanagawa (JP); Hiroaki Umezawa, Kanagawa (JP); Kiichirou Shimizu, Kanagawa (JP); Natsuko Kawase, Kanagawa (JP); Ryu Hasegawa, Kanagawa (JP); Takashi Enami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 366 days.

(21) Appl. No.: 12/222,324

(22) Filed: Aug. 7, 2008

(65) Prior Publication Data

US 2009/0073247 A1 Mar. 19, 2009

(30) Foreign Application Priority Data

Aug. 7, 2007 (JP) ..... 2007-205814
Jun. 23, 2008 (JP) ..... 2008-163347

(51) Int. Cl.
*B65H 7/02* (2006.01)

(52) U.S. Cl. ..... 271/258.02; 271/259; 271/258.04

(58) Field of Classification Search ..... 271/9.01, 271/9.02, 9.12, 9.13, 9.05, 258.01, 258.02, 271/258.04, 259
See application file for complete search history.

(56) References Cited

U.S. PATENT DOCUMENTS 5,203,552 A * 4/1993 Hoshi et al. ..... 271/9.01
5,393,043 A * 2/1995 Nitta ..... 271/9.06
5,678,138 A * 10/1997 Kobayashi et al. ..... 399/18
6,161,829 A * 12/2000 Kusumi ..... 271/9.05
2005/0082737 A1* 4/2005 Sasaki et al. ..... 271/9.12
2006/0006594 A1* 1/2006 Kuru et al. ..... 271/258.02
2006/0145414 A1* 7/2006 Yokobori et al. ..... 271/258.01
2006/0214352 A1* 9/2006 Clark ..... 271/9.01
2007/0053700 A1* 3/2007 Nishikata et al. ..... 399/21
2007/0120313 A1* 5/2007 Wada ..... 271/9.02

FOREIGN PATENT DOCUMENTS

| | | |
|---|---|---|
| JP | 06-040603 | 2/1994 |
| JP | 08-225241 | 9/1996 |
| JP | 3420310 | 4/2003 |
| JP | 2004-161498 | 6/2004 |
| JP | 2004-206079 | 7/2004 |
| JP | 2007-062917 | 3/2007 |

OTHER PUBLICATIONS

Abstract of JP 07-178982 published Jul. 18, 1995.

* cited by examiner

*Primary Examiner* — Kaitlin S Joerger
*Assistant Examiner* — Patrick Cicchino
(74) *Attorney, Agent, or Firm* — Harness, Dickey & Pierce, P.L.C.

(57) ABSTRACT

An image forming apparatus connectable to a first feed tray and a second feed tray includes an image forming unit, a feed path, and a detecting unit provided on the feed path to sense recording medium jam. An identifying unit identifies a feed path and a feed tray where recording medium jam has occurred as a jammed path and a jamming feed tray. A first determining unit determines whether the image forming apparatus is connected to the second feed tray. A second determining unit determines whether the second feed tray can feed a recording medium to the image forming unit. A feeding unit feeds a recording medium from the second feed tray to the image forming unit.

11 Claims, 14 Drawing Sheets

FIG. 7

| SENSOR THAT DETECTS PAPER JAM | FIRST FEED UNIT 150a | SECOND FEED UNIT 150b | THIRD FEED UNIT 150c |
|---|---|---|---|
| SENSOR 152a | IMPOSSIBLE | IMPOSSIBLE | IMPOSSIBLE |
| SENSOR 154a | IMPOSSIBLE | POSSIBLE | POSSIBLE |
| SENSOR 152b | POSSIBLE | IMPOSSIBLE | IMPOSSIBLE |
| SENSOR 154b | POSSIBLE | IMPOSSIBLE | POSSIBLE |
| SENSOR 152c | POSSIBLE | POSSIBLE | IMPOSSIBLE |
| SENSOR 154c | POSSIBLE | POSSIBLE | IMPOSSIBLE |
| ⋮ | ⋮ | ⋮ | ⋮ |
| | | | |
| | | | |

METHOD, APPARATUS, AND SYSTEM FOR FORMING IMAGE

CROSS-REFERENCE TO RELATED APPLICATIONS

The present application claims priority to and incorporates by reference the entire contents of Japanese priority document 2007-205814 filed in Japan on Aug. 7, 2007 and Japanese priority document 2008-163347 filed in Japan on Jun. 23, 2008.

BACKGROUND OF THE INVENTION

1. Field of the Invention

The present invention relates to a technology for forming an image on a recording medium that is fed from one of a plurality of feed paths in an image forming apparatus, and more particularly, to a technology for recovering from a paper jam in a feed path.

2. Description of the Related Art

Most of the image forming apparatuses including copiers and electrographic printers include a plurality of feed trays on which papers of different sizes are stacked. A paper is picked up from one of the feed trays and conveyed to an image forming unit through a corresponding one of a plurality of feed paths. A paper sensor is arranged in each of the feed paths to sense a paper passing through that feed path. When a sensor detects a paper jam, information about where the paper jam has occurred is displayed on a display unit for a user. Some of the image forming apparatuses additionally display a guidance screen on the display unit to guide the user how to remove the jammed paper.

Japanese Patent Application Laid-open No. 2007-62917 discloses a sheet conveyer and an image forming apparatus including the sheet conveyer, from which the user can easily remove a paper jammed near a registration roller. The sheet conveyer includes a registration guide member that is located upstream of the registration roller or a conveyer roller with respect to a sheet conveyer path. The registration guide member is supported in a rotatable manner around a fulcrum that is located upstream. With this configuration, the registration guide member can move between a first position at which the registration guide member works as a part of the sheet conveyer path and a second position at which the registration guide member makes the sheet conveyer path opened. Thus, the registration guide member can be turned easily, the range of movement of the registration guide member is also relatively large so that the sheet conveyer path can be opened widely. Therefore, the user can easily remove the jammed paper from the sheet conveyer.

There are several advantages in usage of multiple feed trays instead of a single feed tray. The first advantage is to decrease frequency of sheet setting by setting various types of recording media on the feed trays. If the single feed tray is used, the user has to set a desired-sized recording medium on a bypass tray each time the user uses. The second advantage is that, even if a paper jam occurs while the recording medium is conveyed from a first feed tray, it is possible to smoothly finish printing by feeding a recording medium from a second feed tray instead of the first feed tray. To improve productivity of the image forming apparatus by immediately recovering from the paper jam, a measure making full use of those advantages with the multiple feed trays will be effective.

The operation of the sheet conveyer disclosed in Japanese Patent Application Laid-open No. 2007-62917 must be stopped until the jammed paper is removed. This can lead to decrease in the productivity.

SUMMARY OF THE INVENTION

It is an object of the present invention to at least partially solve the problems in the conventional technology.

According to an aspect of the present invention, there is provided an image forming apparatus connectable to a plurality of recording medium feed trays including at a first feed tray and a second feed tray. The image forming apparatus includes an image forming unit that forms an image on a recording medium conveyed from one of the feed trays; a feed path that connects a corresponding feed tray of the feed trays to the image forming unit, the feed path including a first feed path that connects the first feed tray to the image forming unit and a second feed path that connects the second feed tray to the image forming unit; a detecting unit provided on the feed path to sense recording medium jam in the feed path, the detecting unit including a first detecting unit that senses recording medium jam in the first feed path and a second detecting unit that senses recording medium jam in the second feed path; an identifying unit that identifies a feed path and a feed tray where recording medium jam has occurred as a jammed path and a jamming feed tray from information from the detecting unit; a first determining unit that determines whether the image forming apparatus is connected to the second feed tray; a second determining unit that determines, when the first determining unit determines that the image forming apparatus is connected to the second feed tray, whether the second feed tray can feed a recording medium to the image forming unit based on the jammed path that is identified by the identifying unit; and a feeding unit that feeds, when the second determining unit determines that the second feed tray can feed a recording medium, a recording medium from the second feed tray to the image forming unit.

According to another aspect of the present invention, there is provided an image forming system including an image forming apparatus and a plurality of recording medium feed trays connected to the image forming apparatus, the recording medium feed trays including at a first feed tray and a second feed tray. The image forming system including an image forming unit that forms an image on a recording medium conveyed from one of the feed trays; a feed path that connects a corresponding feed tray of the feed trays to the image forming unit, the feed path including a first feed path that connects the first feed tray to the image forming unit and a second feed path that connects the second feed tray to the image forming unit; a detecting unit provided on the feed path to sense recording medium jam in the feed path, the detecting unit including a first detecting unit that senses recording medium jam in the first feed path and a second detecting unit that senses recording medium jam in the second feed path; an identifying unit that identifies a feed path and a feed tray where recording medium jam has occurred as a jammed path and a jamming feed tray from information from the detecting unit; a first determining unit that determines whether the image forming apparatus is connected to the second feed tray; a second determining unit that determines, when the first determining unit determines that the image forming apparatus is connected to the second feed tray, whether the second feed tray can feed a recording medium to the image forming unit based on the jammed path that is identified by the identifying unit; and a feeding unit that feeds, when the second determining unit determines that the second feed tray can feed a recording medium, feeds a recording medium from the second feed tray to the image forming unit.

According to still another aspect of the present invention, there is provided an image forming method implemented on an image forming apparatus connectable to a plurality of recording medium feed trays, the recording medium feed trays including at a first feed tray and a second feed tray, and the image forming apparatus including an image forming unit that forms an image on a recording medium conveyed from one of the feed trays; a feed path that connects a corresponding feed tray of the feed trays to the image forming unit, the feed path including a first feed path that connects the first feed tray to the image forming unit and a second feed path that connects the second feed tray to the image forming unit; and a detecting unit provided on the feed path to sense recording medium jam in the feed path, the detecting unit including a first detecting unit that senses recording medium jam in the first feed path and a second detecting unit that senses recording medium jam in the second feed path. The image forming method including identifying a feed path and a feed tray where recording medium jam has occurred as a jammed path and a jamming feed tray from information from the detecting unit; first determining including determining whether the image forming apparatus is connected to the second feed tray; second determining including determining, when it is determined at the first determining that the image forming apparatus is connected to the second feed tray, whether the second feed tray can feed a recording medium to the image forming unit based on the jammed path that is identified by the identifying unit; and feeding, when it is determined at the second determining that the second feed tray can feed a recording medium, a recording medium from the second feed tray to the image forming unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 7 is a table of feed trays from which a recording medium can be re-fed when one of sensors detects a paper jam;

DETAILED DESCRIPTION OF THE PREFERRED EMBODIMENTS

Exemplary embodiments of the present invention are described in detail below with reference to the accompanying drawings.

The present invention is applied to a laser printer, which is an image forming apparatus, in the following embodiments. However, the present invention can be applied to any other image forming apparatus, such as an electrographic copier or a multifunction peripheral (MFP) having various functions of copier, facsimile machine, printer, or the like that has a configuration described below. A recording medium described in the following embodiments includes paper sheets, overhead projector (OHP) sheets, or the like on which an image can be formed with an image forming apparatus.

Figure 1:
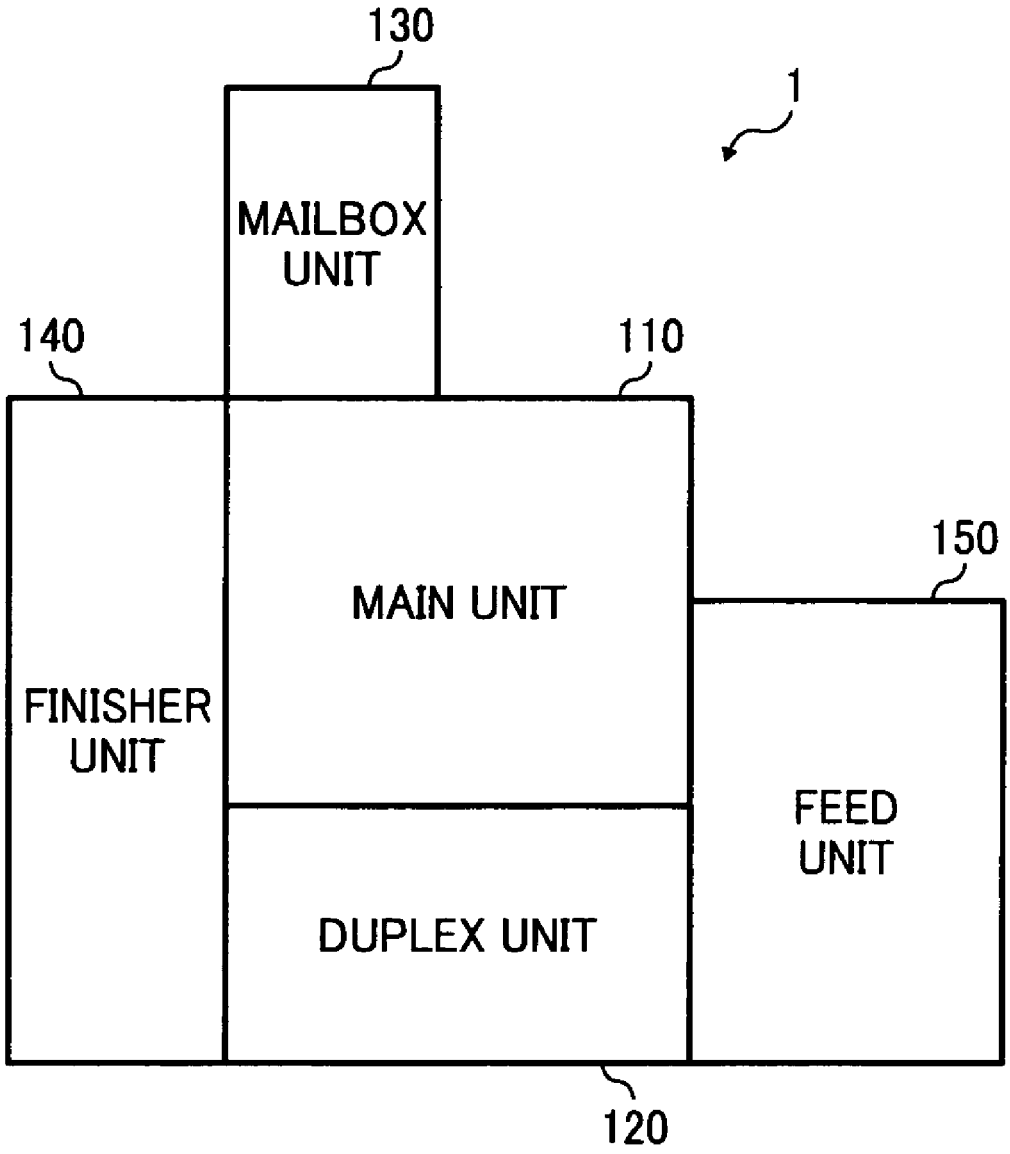
FIG. 1 is a schematic diagram of a laser printer according to a first embodiment of the present invention.

The structure of a laser printer 1 according to a first embodiment of the present invention is explained below. FIG. 1 is a schematic diagram of the laser printer 1. The laser printer 1 includes a main unit 110, a duplex unit 120, a mailbox unit 130, a finisher unit 140, and a feed unit 150.

The main unit 110 includes an image forming unit including a registration unit (not shown) and a fixing unit (not shown). The image forming unit prints (i.e., forms) an image on a recording medium. The main unit 110 controls a printing process (i.e., image forming process) that includes a forming process, a developing process, and a fixing process, etc. The main unit 110 includes a conveying unit (not shown) that conveys a recording medium on which an image is to be printed to the image forming unit.

The duplex unit 120 includes a switch-back mechanism (not shown). The switch-back mechanism receives a recording medium, on a front surface of which an image has been formed, from the main unit 110 reverses the recording medium and returns the recording medium to the main unit 110 so that an image can be formed on a back surface of the recording medium.

The mailbox unit 130 includes a plurality of ejection ports (not shown). The printed recording medium, i.e., copy is ejected through any one of the ejection ports. The mailbox unit 130 is, but not limited to, a two-bin mailbox.

The finisher unit 140 performs post-processes including punching, stapling, and stacking of copies.

The feed unit 150 includes a feed tray (not shown) on which one or more recording media are stacked, and a feed path (not shown) running from the feed tray to the image forming unit in the main unit 110. The feed unit 150 conveys one recording medium from the feed tray to the registration unit though the feed path. It is possible to connect a plurality of the feed units 150 to each other as described in detail later. The feed path includes an individual path corresponding to each of the feed units 150 and a common path. An individual path connects a feed tray in a corresponding one of the feed units 150 to the common path. The common path connects all the individual paths to the image forming unit. Thus, a recording medium coming from any one of the individual paths passes through the common path.

Figure 2:
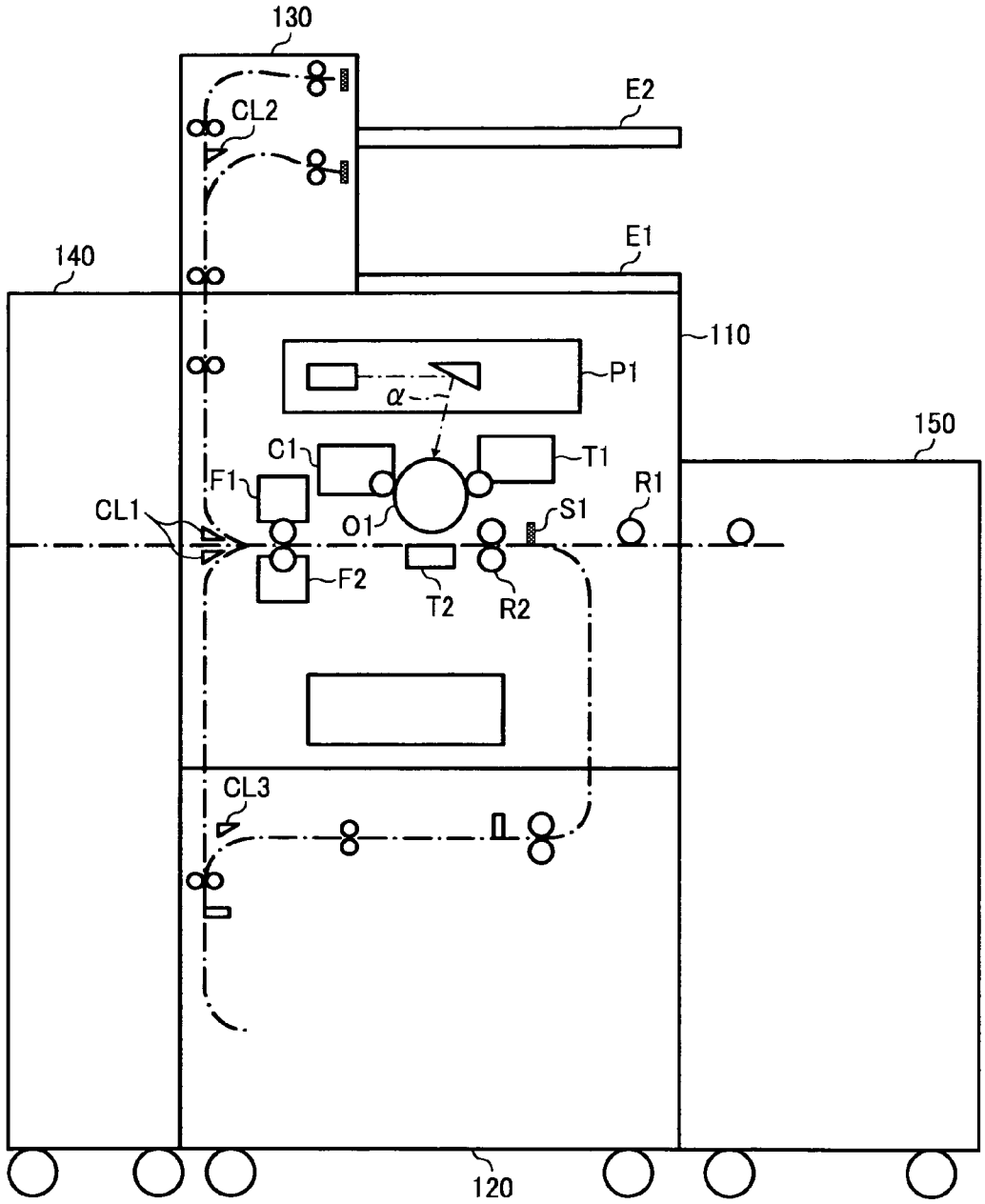
FIG. 2 is a side view of the laser printer shown in FIG. 1.

FIG. 2 is a side view of the laser printer 1. The main unit 110 includes a conveyer roller R1, a registration roller R2, a registration sensor S1, a photoconductor unit O1, a development unit T1, a transfer unit T2, a cleaning unit C1, an optical writing unit P1, a thermal fixing roller F1, a pressure fixing roller F2, and a switching solenoid CL1. The mailbox unit 130 includes an upper switching solenoid CL2, a few sets of rollers, a mailbox catch tray E1, and a mailbox catch tray E2. The duplex unit 120 includes a lower switching solenoid CL3 and a few sets of rollers.

The printing process from the paper feeding to the copy ejection is described below. The conveyer roller R1 conveys the recording medium received from the feed unit 150 to the registration roller R2 one by one. When the recording medium reaches the registration sensor S1, the registration roller R2 stops rotating so that the recording medium does not move.

In the state that the recording medium is not moving, a toner image is formed on the photoconductor unit O1. More particularly, after an electrostatic charger (not shown) electrostatically charges the photoconductor unit O1, an optical scanner of the optical writing unit P1 emits a laser light $\alpha$ onto the photoconductor unit O1. As a result, the photoconductor unit O1 has a first area exposed with the laser light $\alpha$ and a second area un-exposed with the laser light $\alpha$. The electric-potential level of the first area differs from that of the second area, which results in a latent image. The development unit T1 evenly applies developer (toner) to the latent image thereby converting the latent image into a toner image. The photoconductor unit O1 is, but not limited to, an organic photoconductor (OPC).

The registration roller R2 starts rotating again so that the recording medium that is waiting at the registration sensor S1 is conveyed to the transfer unit T2. The toner image on the photosensitive element is transferred onto the recording medium as the recording medium passed though the transfer unit T2. The cleaning unit C1 removes toners remained on the photoconductor unit O1 after the toner image has been transferred onto the recording medium. The toner image is fixed on the recording medium with thermal and pressure while the recording medium passes between the thermal fixing roller F1 and the pressure fixing roller F2. After that, the recording medium is conveyed to an ejection unit, which can be the finisher unit 140, the duplex unit 120, or the mailbox unit 130, by the operation of the solenoids CL1 to CL3 and other sensors, and is ejected out of the main unit 110. If ejection unit is the duplex unit 120, i.e., if the duplex unit 120 receives the recording medium from the main unit 110, the duplex unit 120 reverses the recording medium and returns it to the main unit 110 so that an image can be printed on the back side of the recording medium.

The solenoids are a member that switches directions in which the recording medium is to be conveyed (hereinafter, "conveying direction"). For example, the switching solenoid CL1 switches the conveying directions so that the recording medium is conveyed to any one of the finisher unit 140, the duplex unit 120, and the mailbox unit 130. In the mailbox unit 130, the solenoid CL2 switches the conveying directions so that the recording medium is ejected onto either the mailbox catch tray E1 or the mailbox catch tray E2. In the duplex unit 120, the solenoid CL3 switches conveying paths of the recording medium so that the conveying direction of the recording medium is reversed.

Figure 3:
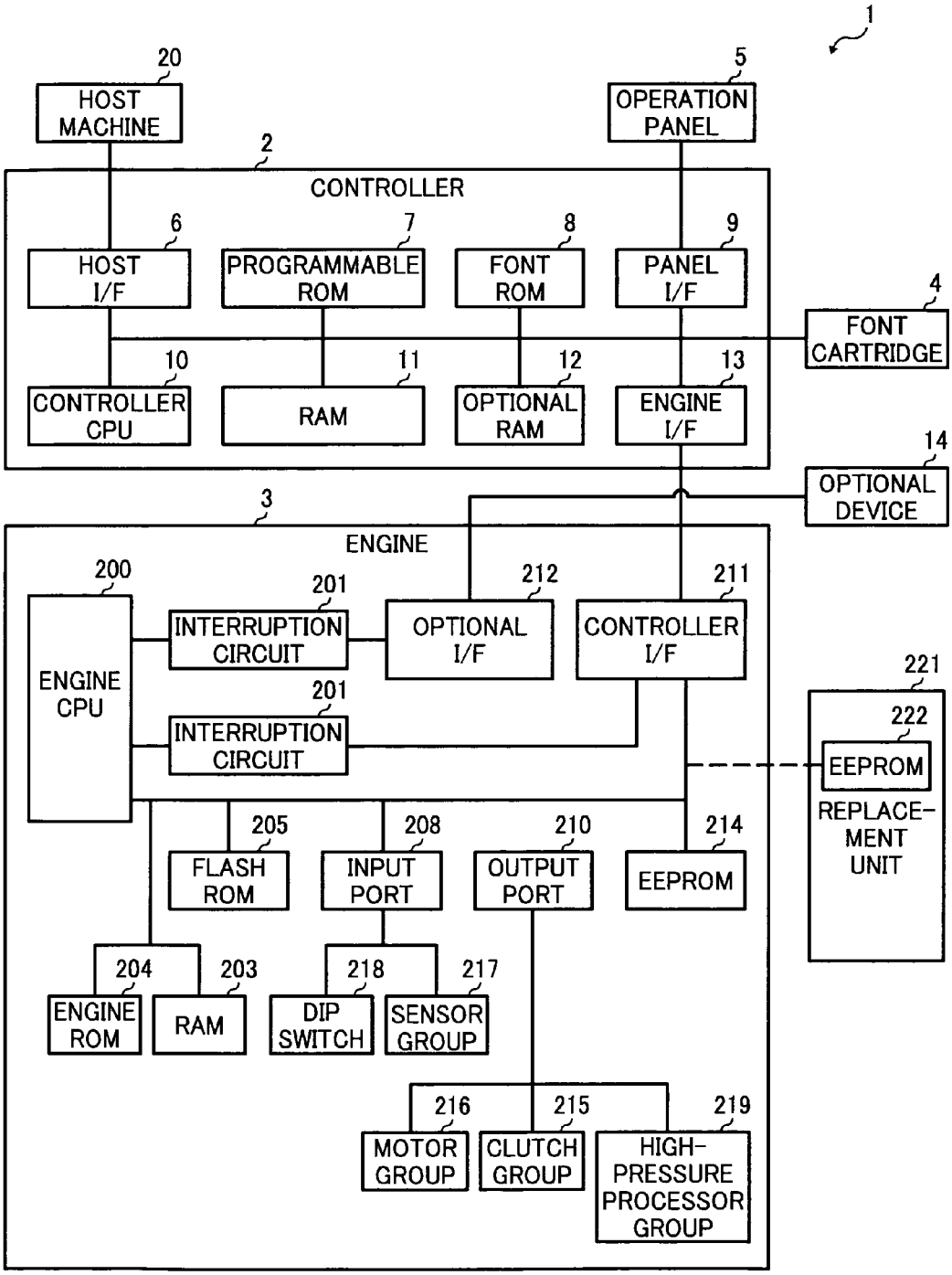
FIG. 3 is a block diagram of a control system of the laser printer shown in FIG. 1.

FIG. 3 is a block diagram of a control system of the laser printer 1. The laser printer 1 includes a controller 2, an engine 3, and an operation panel 5. The controller 2 controls operations of an interface that connects the laser printer 1 to a host machine 20, and operations for editing image data. The engine 3 performs various mechanical controls such as image forming, image writing, and status monitoring. The operation panel 5 is a user interface and receives input of commands and/or data from a user.

The host machine 20 is an external device and it can be a typical computer. The host machine 20 transmits/receives data to/from the laser printer 1.

The controller 2 includes a host interface (I/F) 6, a programmable read only memory (ROM) 7, a font ROM 8, a panel I/F 9, a controller central processing unit (CPU) 10, a random access memory (RAM) 11, an optional RAM 12, and an engine I/F 13. The controller 2 is connected to the host machine 20 via the host I/F 6, to the operation panel 5 via the panel I/F 9, and to a font cartridge 4 that stores therein various fonts.

Upon receiving a suspend request from the engine 3, the controller 2 suspends the feeding operation and stops the printing operation. The suspend request is a request to suspend the feeding operation due to a paper jam. Upon receiving a resume request from the engine 3, the controller 2 resumes the feeding operation and re-starts the printing operation from the suspended page.

The host I/F 6 connects the controller 2 to the host machine 20. The programmable ROM 7 stores therein computer programs for editing image data or controlling the controller 2. The font ROM 8 stores therein the standard fonts for printing. The panel I/F 9 connects the controller 2 to the operation panel 5.

The controller CPU 10 controls data transaction between the laser printer 1 and the host machine 20 by executing the computer program stored in the programmable ROM 7, and controls the controller 2 by controlling image processing. The RAM 11 and the optional RAM 12 are memories on which a processing program, a control program, data such as image data, or the like are loaded. The engine I/F 13 connects the controller 2 to the engine 3.

The engine 3 includes an engine CPU 200 a controller I/F 211, an interruption circuit 201 corresponding to the controller I/F 211, an optional I/F 212, an interruption circuit 201 corresponding to the optional I/F 212, a flash ROM 205, an input port 208, an output port 210, an electrically erasable and programmable read only memory (EEPROM) 214, an engine ROM 204, a RAM 203, a dual in-line package (DIP) switch 218, a group of sensors (hereinafter, "sensor group") 217, a group of motors (hereinafter, "motor group") 216, a group of clutches (hereinafter, "clutch group") 215, and a group of high-pressure processors (hereinafter, "high-pressure processor group") 219.

The engine CPU 200 controls the engine 3 by executing the control program. The interruption circuit 201 controls an interruption state. The controller I/F 211 connects the engine 3 to the controller 2 via the engine I/F 13. The optional I/F 212 connects the engine 3 to an optional device 14.

The flash ROM 205 stores therein various computer programs and various data. The input port 208 performs input processing, i.e., receiving data about various setting conditions concerning image forming and various device statuses. The output port 210 performs output processing for implementing the image forming processing. The EEPROM 214 stores therein maintenance information or the like. The engine ROM 204 stores therein computer programs for controlling the engine 3. The RAM 203 has a function as a buffer register, and is used as a working memory.

The DIP switch 218 switches the control modes, etc. The sensors in the sensor group 217 sense various parameters such as conveying timing, internal and/or external temperature, toner density. The motor group 216 includes a main motor (not shown) and a conveying motor (not shown). The clutches in the clutch group 215 drive or stop various members such as the feed roller, the registration roller. The processors in the high-pressure processor group 219 perform high-pressure processing such as charging, transferring, and developing.

The engine 3 is connected to a replacement unit 221 that includes an EEPROM 222.

Figure 4:
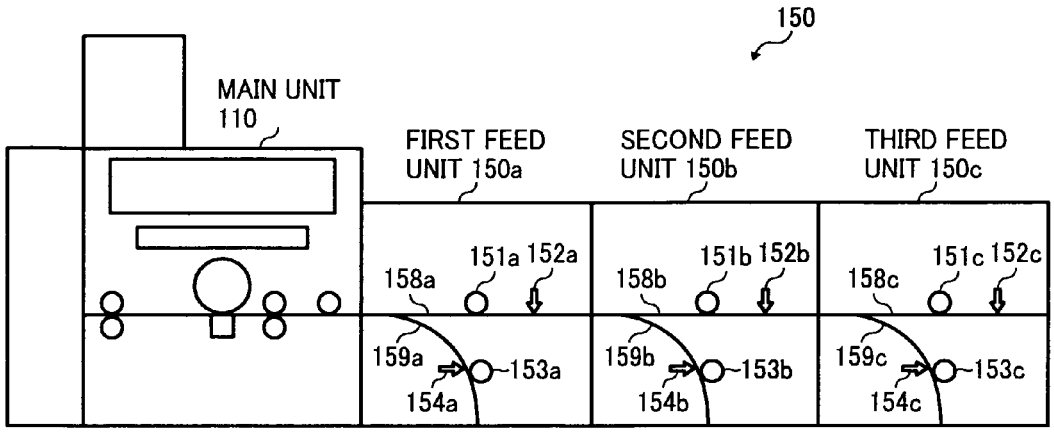
FIG. 4 is a schematic side view of a feed unit shown in FIG. 1.
Figure 5:
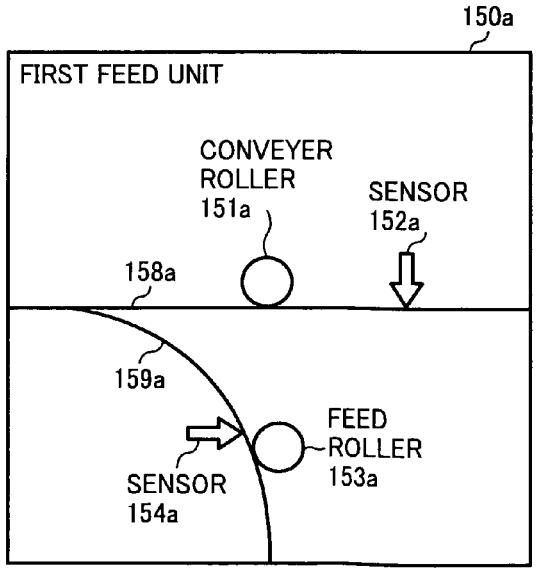
FIG. 5 is an enlarged schematic side view of a first feed unit shown in FIG. 4.

FIG. 4 is a schematic side view of the feed unit 150. FIG. 5 is an enlarged schematic side view of a first feed unit shown in FIG. 4.

The feed unit 150, as shown in FIG. 4, includes a first feed unit 150*a*, a second feed unit 150*b*, and a third feed unit 150*c*. The first feed unit 150*a*, the second feed unit 150*b*, and the third feed unit 150*c* include a common path 158*a*, a common path 158*b*, and a common path 158*c*, respectively. The first feed unit 150*a*, the second feed unit 150*b*, and the third feed unit 150*c* are arranged in this order with the first feed unit 150*a* being closest to the main unit 110, and are connected to each other so that the common paths 158*a*, 158*b*, and 158*c* form a continuous feed path.

The first feed unit 150*a*, the second feed unit 150*b*, and the third feed unit 150*c* are attached to the main unit 110 in a detachable manner. Although three feed units are shown in FIG. 4, the number of feed units can be any number larger than one. The structure and operations of the first feed unit 150*a* will be explained below with reference to FIG. 5. The second feed unit 150*b* and the third feed unit 150*c* have similar structure and they perform similar operations as the first feed unit 150*a*.

In the laser printer 1, with regardless whether the feed unit is single or multiple, the flash ROM 205 pre-stores therein a computer program for a re-printing determining process. Therefore, when a new feed unit is added, it is unnecessary to install the computer program for the re-printing determining process in the new feed unit, which saves a part of workload concerning a customizing operation.

The first feed unit 150*a*, as shown in FIG. 5, includes the common path 158*a* and the individual path 159*a* as the feed path through which the recording medium is conveyed from the feed tray (not shown) to the image forming unit of the main unit 110. The first feed unit 150*a* includes a conveyer roller 151*a* that conveys the recording medium from the common path 158*a* to the registration roller R2 of the main unit 110, a sensor 152*a*, a feed roller 153*a* that feeds the recording medium out of the feed tray, and a sensor 154*a*.

The individual path 159*a* is connected to the feed tray that is provided at a lower part of the feed unit 150, running from bottom up passing the left side of the feed unit 150. When the recording medium is picked up from the feed tray, the recording medium first passes through the individual path 159*a*. The common path 158*a* connects the individual path 159*a* to the image forming unit. The recording media from the other feed units 150*b* and 150*c* passes through the common path 158*a*.

The sensor 154*a* is provided in the individual path 159*a* to detect a paper jam in the individual path 159*a*. The sensor 152*a* is provided in the common path 158*a* to detect a paper jam in the common path 158*a*.

Because the first to third feed units 150*a* to 150*c* have a common structure, for example, the first feed unit 150*a* and the third feed unit 150*c* can be replaced with each other. Moreover, if a paper jam occurs in an individual path of one feed unit, it is possible to re-feed a recording medium from another feed unit.

Figure 6:
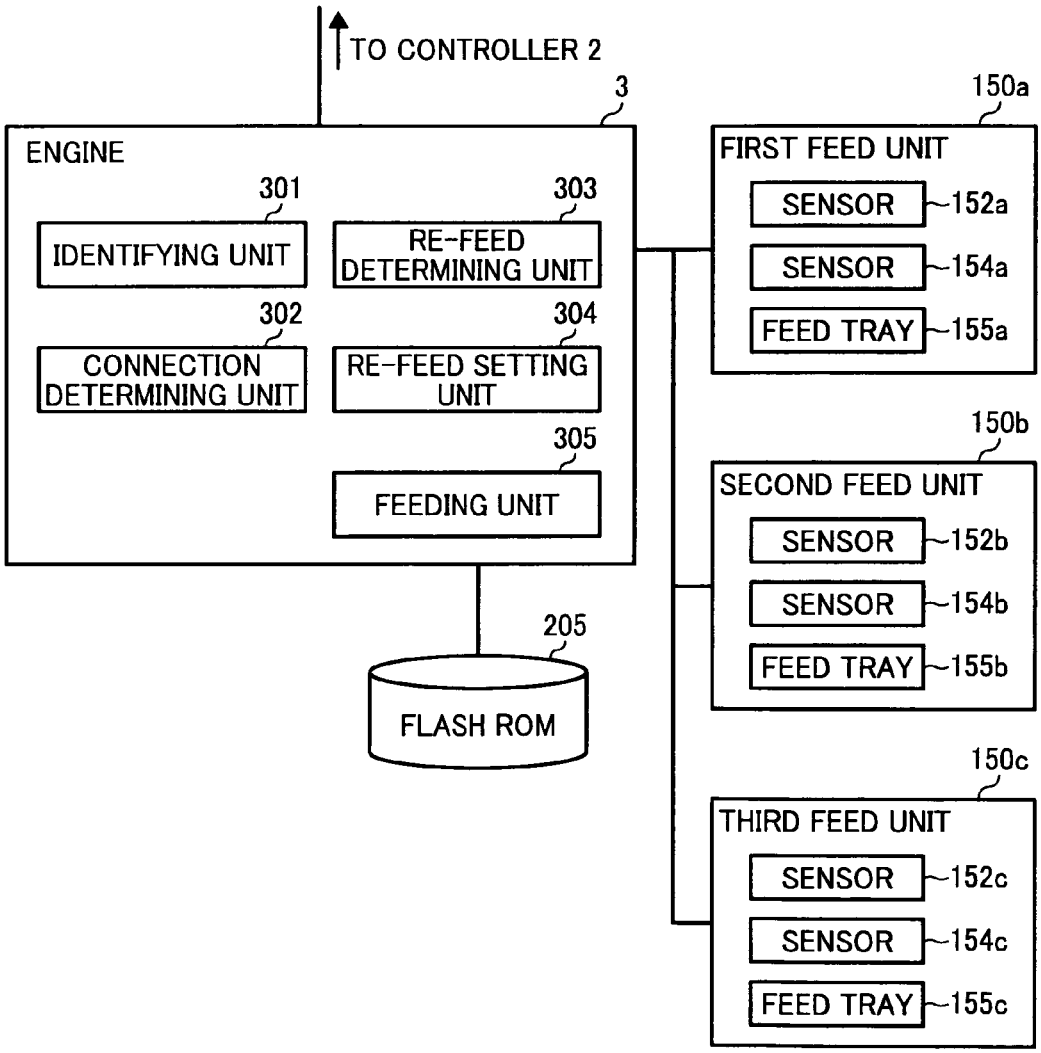
FIG. 6 is a block diagram of an engine shown in FIG. 3.

The control operation of the engine 3 is explained below. FIG. 6 is a block diagram of the engine 3.

The engine 3 includes an identifying unit 301, a connection determining unit 302, a re-feed determining unit 303, a re-feed setting unit 304, and a feeding unit 305. The engine 3 is connected to the flash ROM 205, the first feed unit 150*a*, the second feed unit 150*b*, and the third feed unit 150*c*.

The first feed unit 150*a* includes the sensor 152*a*, the sensor 154*a*, and a feed tray 155*a*. The second feed unit 150*b* includes the sensor 152*b*, the sensor 154*b*, and a feed tray 155*b*. The third feed unit 150*c* includes the sensor 152*c*, the sensor 154*c*, and a feed tray 155*c*. The explanation about those components has already been described, and therefore the same explanation is not repeated (see FIGS. 4 and 5).

The identifying unit 301 identifies, when any one of the sensors 152*a*, 154*a*, 152*b*, 154*b*, 152*c*, 154*c* detects a paper jam, the feed path on which the paper jam has occurred as a jammed path. The identifying unit 301 identifies the feed tray from which the jammed recording medium (hereinafter, "jammed paper") is conveyed to the jammed path as a jamming feed tray.

Assume that the sensor 154*a* provided on the individual path 159*a* detects a paper jam. In this case, the identifying unit 301 receives a detection signal including sensor identification data (sensor ID) of the sensor 154*a* from the sensor 154*a*. The identifying unit 301 identifies the sensor 154*a* from the received sensor ID. The identifying unit 301 then identifies the individual path 159*a* as the jammed path by referring to identification data stored in the flash ROM 205 or the like. The identification data includes sensor IDs and feed-path IDs in a correspondent manner. The identifying unit 301 identifies the feed tray 155*a* connected to the individual path 159*a* that is identified as the jammed path as the jamming feed tray.

Assume now that the sensor 152*c* provided on the common path 158*c* detects a paper jam, the identifying unit 301 receives a detection signal including a sensor ID of the sensor 152*c* from the sensor 152*c*. The identifying unit 301 identifies the sensor 152*c* from the received sensor ID. The identifying unit 301 then identifies the common path 158*c* as the jammed path by referring to the identification data. The identifying unit 301 identifies the feed tray 155*b* connected to the individual path 159*b* through which the jammed paper passes before the common path 158*c* that is identified as the jammed path as the jamming feed tray.

When a paper jam occurs, the connection determining unit 302 determines whether the laser printer 1 is connected to a feed tray on which a recording medium having the same size as the recording medium of the jamming feed tray is stacked (hereinafter, "similar feed tray"). The connection determining unit 302 determines whether there is a plurality of similar feed trays.

More particularly, when the recording medium is set on the feed tray, the size of the recording medium is measured by sensing a length and a width of the recording medium with a sensor provided inside the feed tray or by sensing whether mechanical switches provided inside the feed tray is pressed. The obtained size data is stored in the flash ROM 205 or the like in associated with the feed-tray ID.

When a paper jam occurs, the connection determining unit 302 acquires, by referring to the flash ROM 205, the size data of the recording medium stacked on the jamming feed tray. The connection determining unit 302 compares the acquired size data with size data of the recording medium stacked on another feed tray, and determines whether the laser printer 1 is connected to the similar feed tray.

When the connection determining unit 302 determines that the laser printer 1 is connected to the similar feed tray, the re-feed determining unit 303 determines whether it is possible to re-feed the recording medium from the similar feed tray to the image forming unit based on the position of the sensor provided on the jammed path.

More particularly, if the connection determining unit 302 determines that the feed trays 155*b* and 155*c* are the similar feed trays and the jammed path is the individual paths 159*c*, the re-feed determining unit 303 determines that it is possible to re-feed the recording medium from the feed tray 154*b*.

The re-feed determining unit 303 determines that it is possible to re-feed the recording medium from the similar feed tray if following conditions are satisfied: the connection determining unit 302 determines that the laser printer 1 is connected to the similar feed tray, the jammed path is the common path, and the recording medium can be conveyed from the similar feed tray to the image forming unit without passing through the jammed path.

How the re-feed determining unit 303 determines whether it is possible to re-feed a recording medium from another feed unit is explained below. FIG. 7 is a table of feed trays from which a recording medium can be re-fed when one of the sensors detects a paper jam. The re-feed determining process will be described with reference to FIGS. 6 and 7. In the example shown in FIG. 7, it is assumed that all the feed trays have a same-sized recording media.

If any one of the sensors 154*a*, 154*b*, and 154*c* provided on the individual paths 159*a*, 159*b*, and 159*c* detects a paper jam, the recording medium can pass through any of the common paths 158*a*, 158*b*, and 158*c*. Therefore, the re-feed determining unit 303 determines that it is possible to re-feed the recording medium from another feed tray instead of the jamming feed tray.

If, for example, the sensor 154*a* detects a paper jam, it is possible to re-feed the recording medium from either the second feed unit 150*b* or the third feed unit 150*c*. If the sensor 154*b* detects a paper jam, it is possible to re-feed the recording medium from either the first feed unit 150*a* or the third feed unit 150*c*. If the sensor 154*c* detects a paper jam, it is possible to re-feed the recording medium from either the first feed unit 150*a* or the second feed unit 150*b*.

If the sensor 152*a* provided on the common path 158*a* detects a paper jam, it is impossible to re-feed the recording medium from either the second feed unit 150*b* or the third feed unit 150*c* because the recording medium cannot pass through the common path 158*a* because of the paper jam in the common path 158*a*.

If the sensor 152*b* provided on the common path 158*b* detects a paper jam, it is impossible to re-feed the recording medium from the third feed unit 150*c* because the recording medium cannot pass through the common path 158*b* because of the paper jam in the common path 158*b*. However, it is possible to re-feed the recording medium from the first feed unit 150*a* because the recording medium can be conveyed to the image forming unit without passing through the common path 158*b*.

If the sensor 152*c* provided on the common path 158*c* detects a paper jam, it is possible to re-feed the recording medium from either the first feed unit 150*a* or the second feed unit 150*b* because the recording medium can be conveyed to the image forming unit without passing through the common path 158*c*.

If the re-feed determining unit 303 determines that there is only one feed tray from which the recording medium can be re-fed instead of the jamming feed tray, the re-feed determining unit 303 specifies that feed tray as a re-feed tray. The re-feed determining unit 303 sends a suspend request to the controller 2 to suspend the feeding operation, and then sends a tray-switch notification to the controller 2 to notify that the feed tray from which the recording medium is to be fed is switched to the re-feed feed tray. After sending the tray-switch notification, the re-feed determining unit 303 sends a resume request to the controller 2 to resume the feeding operation. Upon receiving the suspend request, the controller 2 suspends the feeding operation of the feeding unit 305. Upon receiving the resume request, the controller 2 resumes the feeding operation of the feeding unit 305.

The suspended print job is resumed, and an image is printed on the recording medium re-fed from the re-feed tray. When the suspended print job is completed, the re-feed determining unit 303 sends a jammed-paper notification to the controller 2. Upon receiving the jammed-paper notification, the controller 2 performs a predetermined action such as displaying a message requesting the user to remove the jammed paper on the operation panel 5.

If the re-feed determining unit 303 determines that there are multiple feed trays from which the recording medium can be re-fed instead of the jamming feed tray, the re-feed determining unit 303 selects one feed tray from among those multiple feed trays. The re-feed determining unit 303 can select a feed tray based on various criterions. For example, the re-feed determining unit 303 calculates a jam frequency of each of the feed trays by referring to the data in the flash ROM 205, and selects a feed tray having the lowest jam frequency as the re-feed tray. The jam frequency is obtained, for example, by dividing the number of paper jams by the number of recording media that have been fed. Alternatively, the re-feed determining unit 303 can select a feed tray having the lowest number of paper jams as the re-feed tray. Alternatively, the re-feed determining unit 303 can select a feed tray that is nearest to the main unit 110 as the re-feed tray.

The re-feed setting unit 304 receives, after the paper jam occurs, a setting command from the user to start a re-feeding operation.

The feeding unit 305 feeds the recording medium from any one of the feed trays 155*a*, 155*b*, and 155*c* to the image forming unit. If the re-feed setting unit 304 receives the setting command and the re-feed determining unit 303 specifies the re-feed tray, the feeding unit 305 re-feeds the recording medium from the re-feed tray to the image forming unit.

The flash ROM 205 stores therein information including the number of paper jams and the number of recording media having been fed in associated with each of the feed-tray IDs.

Figure 8:
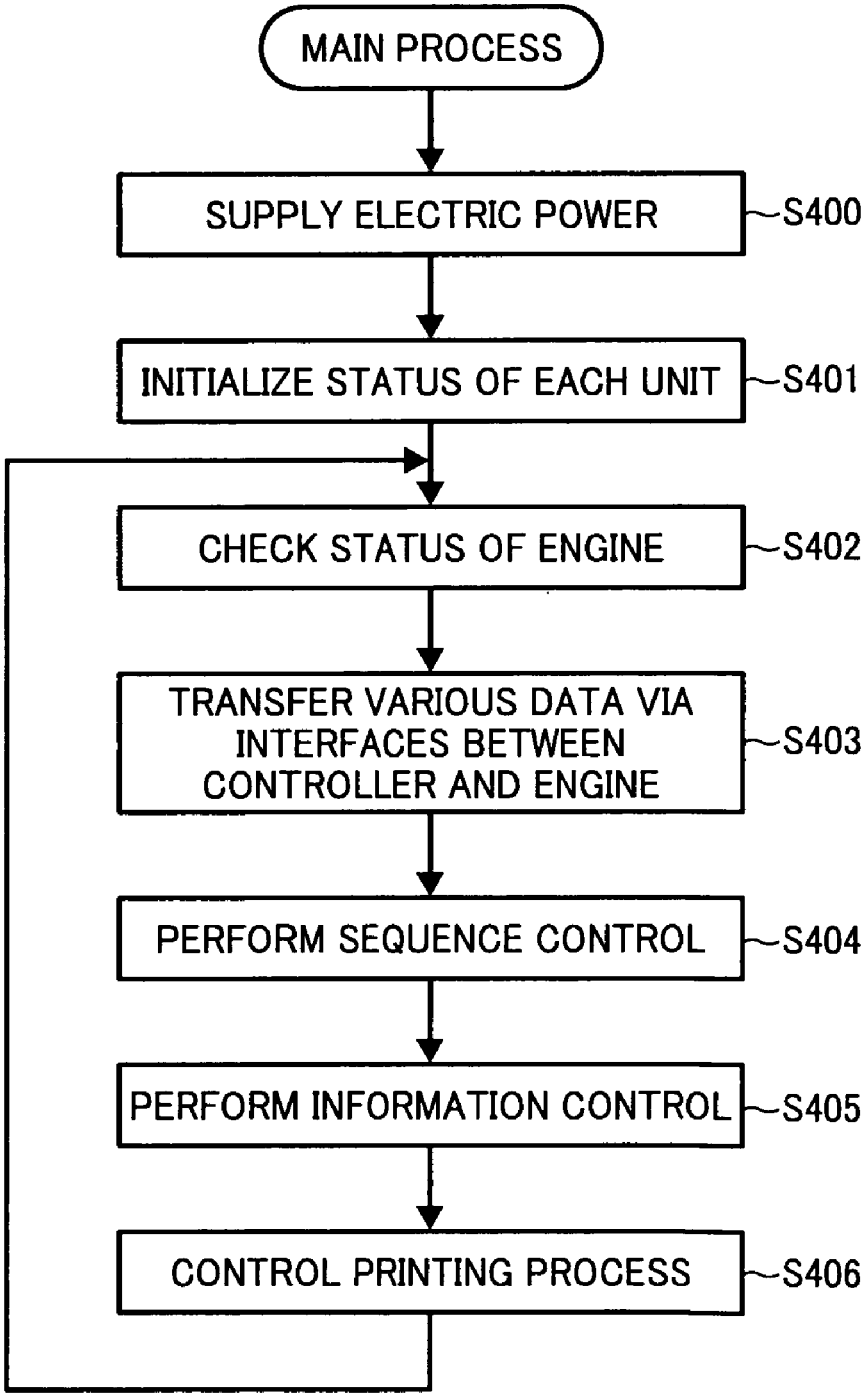
FIG. 8 is a flowchart of a main process according to the first embodiment.

The control operation of the laser printer 1 is explained below. FIG. 8 is a flowchart of a main process according to the first embodiment performed by the laser printer 1.

When the electric power is supplied to the laser printer 1 (Step S400), the laser printer 1 initializes status of each unit (Step S401), and checks status of the engine 3, e.g., checks whether the engine 3 is in failure or is required for maintenance (Step S402). The laser printer 1 transfers various data via the interfaces between the engine 3 and the controller 2 such as a feed command, a resolution-setting request, a feed-tray switch request, and a catch-tray switch request (Step S403), and performs sequence control including feed timing control and high-pressure switching control (Step S404). The laser printer 1 performs information control such as acquiring information about the recording medium on which an image is to be printed (Step S405), and controls the printing process (Step S406). Steps S402 to S406 are repeated afterward.

The laser printer 1 performs, independently from the main process using the interruption circuit 201, a time monitoring process that supports other processes and an interruption process as a control process. Both processes will be described later.

Figure 9:
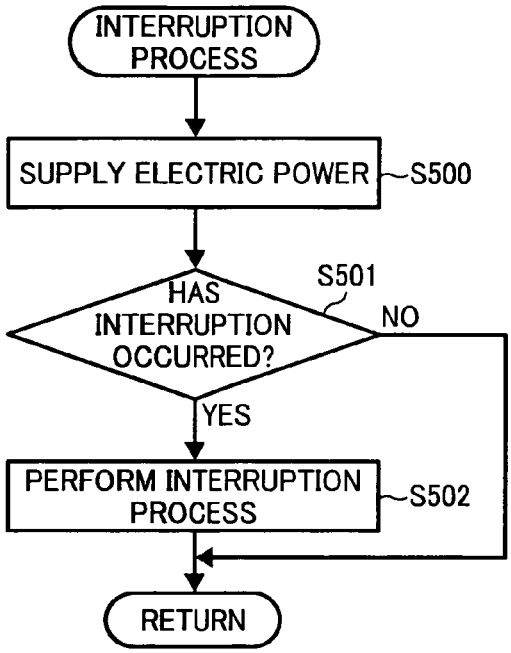
FIG. 9 is a flowchart of an interruption process according to the first embodiment.

FIG. 9 is a flowchart of the interruption process according to the first embodiment performed by the laser printer 1.

When the electric power to the laser printer 1 is turned ON (Step S500), the engine CPU 200 checks whether an interruption has occurred (Step S501). If an interruption has occurred (Yes at Step S501), the engine CPU 200 performs an interruption process (Step S502). If an interruption has not occurred (No at Step S501), the process control goes to end. Steps S501 to S502 are repeated when a predetermined time has passed since the process control goes to end.

Figure 10:
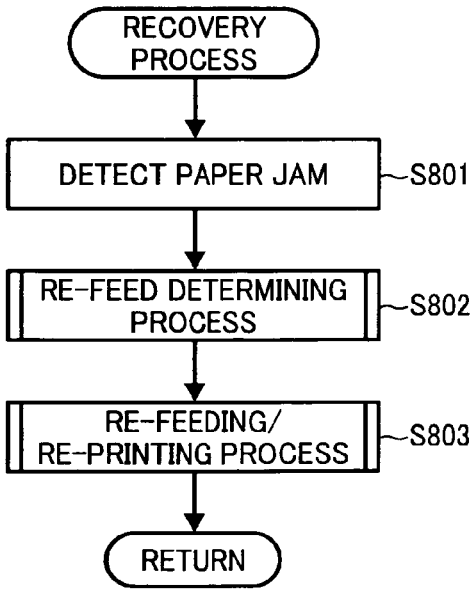
FIG. 10 is a flowchart of a recovery process according to the first embodiment.

How the laser printer 1 recovers from a paper jam is explained below. FIG. 10 is a flowchart of a recovery process according to the first embodiment.

When any one of the sensors detects a paper jam (Step S801), the engine CPU 200 performs a re-feed determining process of determining whether the recording medium can be re-fed from a feed tray other than the jamming feed tray based on a result of the detection (Step S802). Then, the engine CPU 200 performs, based on a result of the re-feed determination, a re-feeding/re-printing process (Step S803).

The re-feed determining process at Step S802 is described in detail below with reference to FIGS. 11 and 12. The re-feeding/re-printing process at Step S803 is described in detail below with reference to FIG. 13. The re-feed determining process starts when the setting command to re-feed the recording medium has been received from the user after a paper jam has occurred.

Figure 11:
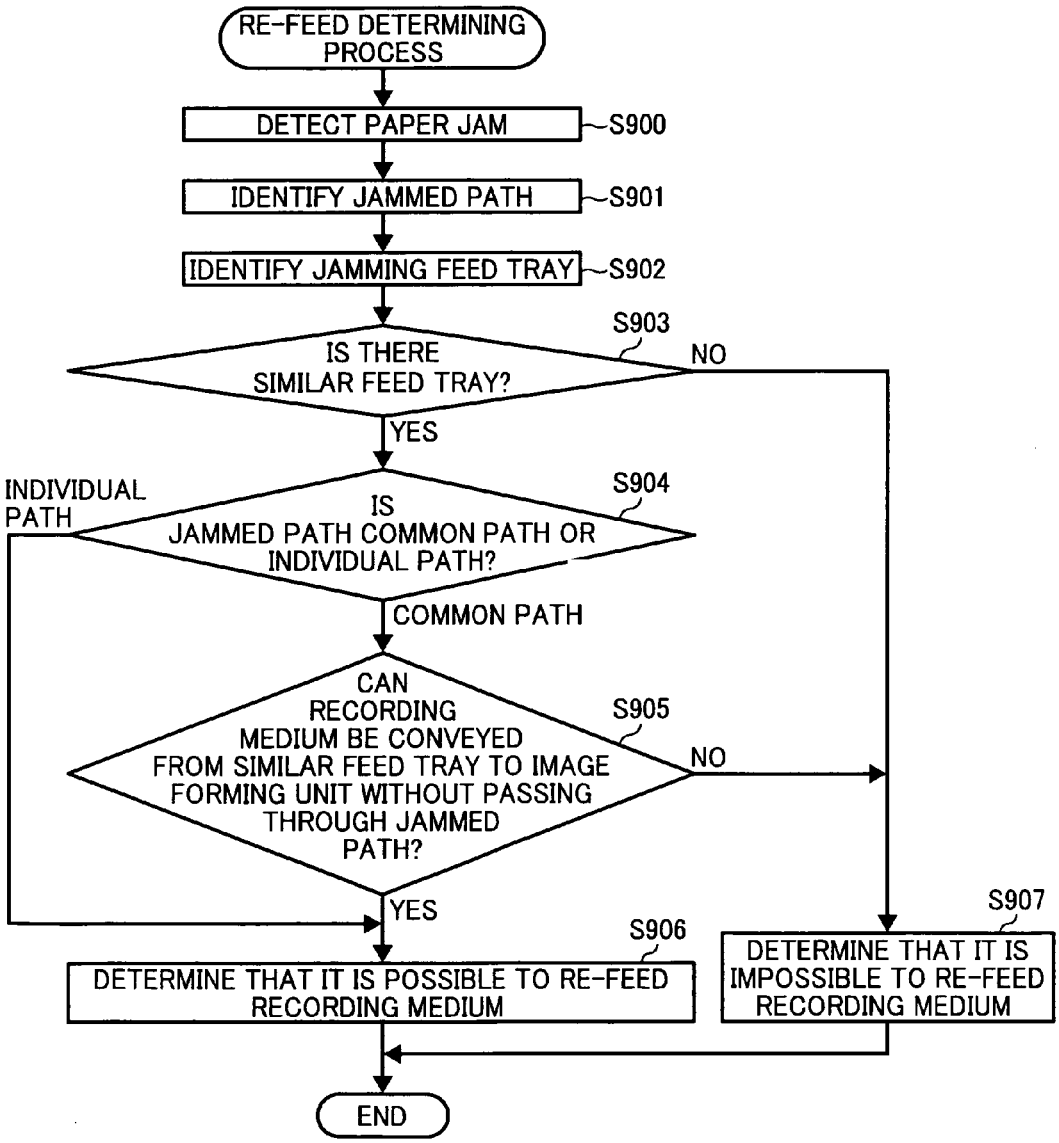
FIG. 11 is a detailed flowchart of one example of a re-feed determining process shown in FIG. 10 according to the first embodiment.

FIG. 11 is a detailed flowchart of one example of the re-feed determining process shown in FIG. 10. When any one of the sensors detects a paper jam (Step S900), the identifying unit 301 identifies the jammed path (Step S901), and identifies the jamming feed tray (Step S902).

The connection determining unit 302 determines whether a feed unit including a similar feed tray is connected to the laser printer 1 (Step S903). If a feed unit including a similar feed tray is connected to the laser printer 1 (Yes at Step S903), the re-feed determining unit 303 determines whether the jammed path is the common path or the individual path (Step S904).

If the jammed path is the common path (Common path at Step S904), the re-feed determining unit 303 determines whether a recording medium can be conveyed from the similar feed tray to the image forming unit without passing through the jammed path (Step S905). If the recording medium can be conveyed from the similar feed tray to the image forming unit without passing through the jammed path (Yes at Step S905), the re-feed determining unit 303 determines that it is possible to re-feed the recording medium (Step S906).

Referring back to Step S904, on the other hand, if the jammed path is the individual path (Individual path at Step S904), the re-feed determining unit 303 determines that it is possible to re-feed the recording medium (Step S906).

If no feed unit including a similar feed tray is connected to the laser printer 1 (No at Step S903) or if the recording medium cannot be conveyed from the similar feed tray to the image forming unit without passing through the jammed path (No at Step S905), the re-feed determining unit 303 determines that it is impossible to re-feed the recording medium (Step S907).

In the re-feed determining process, it is allowable to determine whether it is possible to re-feed the recording medium based on data indicative of performances of each feed unit. FIG. 12 is a detailed flowchart of another example of the re-feed determining process according to the first embodiment. The explanation about Steps S1000 to S1005 will be omitted, because, those steps are similar to Steps S900 to S905 shown in FIG. 11.

If the recording medium can be conveyed from the similar feed tray to the image forming unit without passing through the jammed path (Yes at Step S1005) or if the jammed path is the individual path (Individual path at Step S1004), the re-feed determining unit 303 determines whether there multiple feed trays from which the recording medium can be re-fed instead of the jamming feed tray (Step S1006). If there are multiple feed trays from which the recording medium can be re-fed (Yes at Step S1006), the re-feed determining unit 303 selects a feed tray having the lowest jam frequency as the re-feed tray by referring to the flash ROM 205 (Step S1007). The re-feed determining unit 303 determines that it is possible to re-feed the recording medium from the selected re-feed tray (Step S1008). On the other hand, if there is not a plurality of feed trays from which the recording medium can be re-fed, i.e., the feed tray from which the recording medium can be re-fed is single (No at Step S1006), the re-feed determining unit 303 specifies the single feed tray as the re-feed tray, and determines that it is possible to re-feed the recording medium from the re-feed tray (Step S1008).

If there is no feed unit including a similar feed tray (No at Step S1003) or if the recording medium cannot be conveyed from the similar feed tray to the image forming unit without passing through the jammed path (No at Step S1005), the re-feed determining unit 303 determines that it is impossible to re-feed the recording medium (Step S1007).

Figure 12:
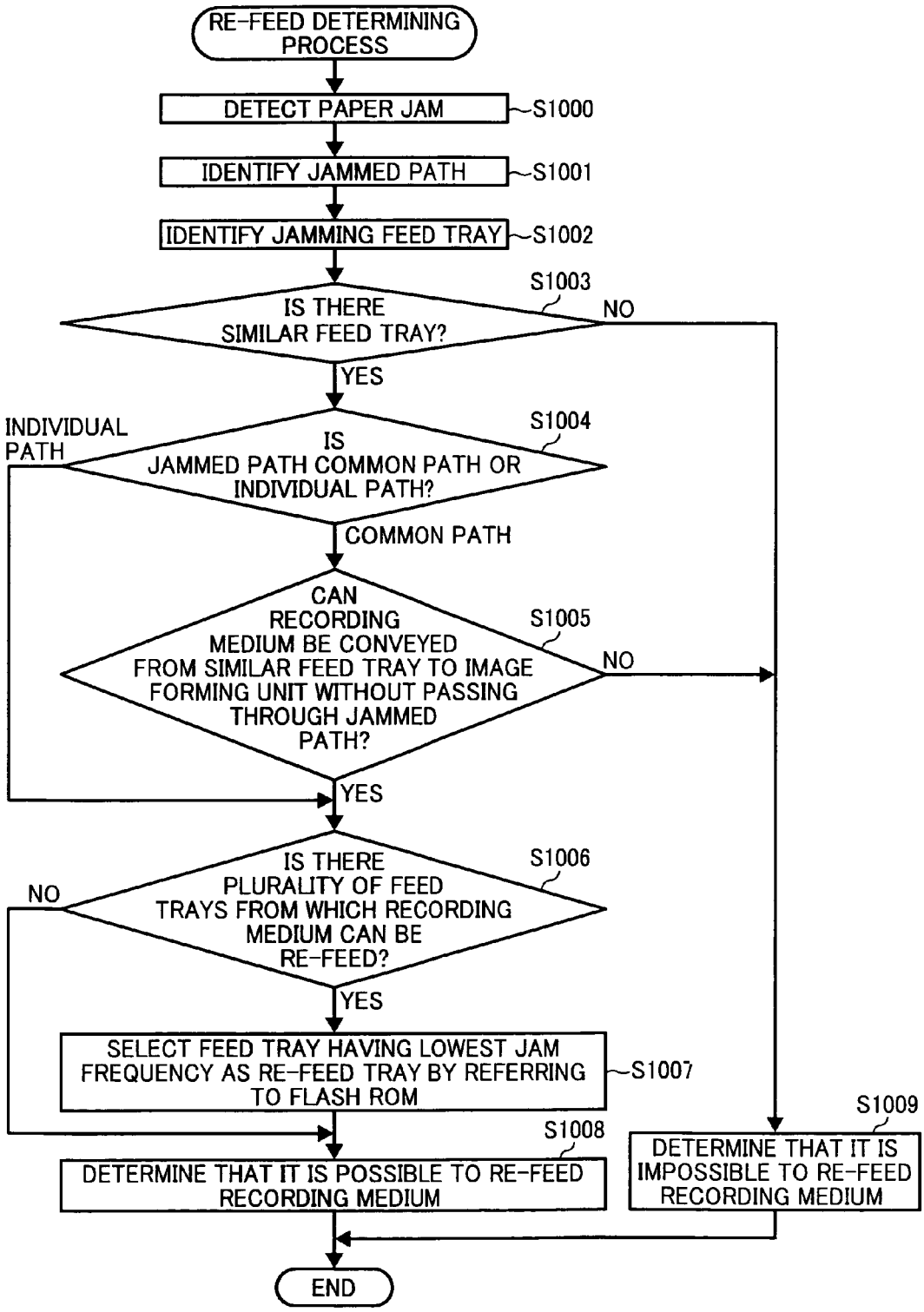
FIG. 12 is a detailed flowchart of another example of re-feed determining process shown in FIG. 10 according to the first embodiment.

Although the feed tray having the lowest jam frequency is selected as the re-feed tray in the re-feed determining process shown in FIG. 12, the feed tray having the lowest number of paper jams can be selected, instead. In other words, the re-feed determining unit 303 can select the feed tray having the lowest number of paper jams as the re-feed tray by referring to the flash ROM 205 at Step S1007. Alternatively, both the jam frequency and the number of paper jams can be used to select the re-feed tray.

Figure 13:
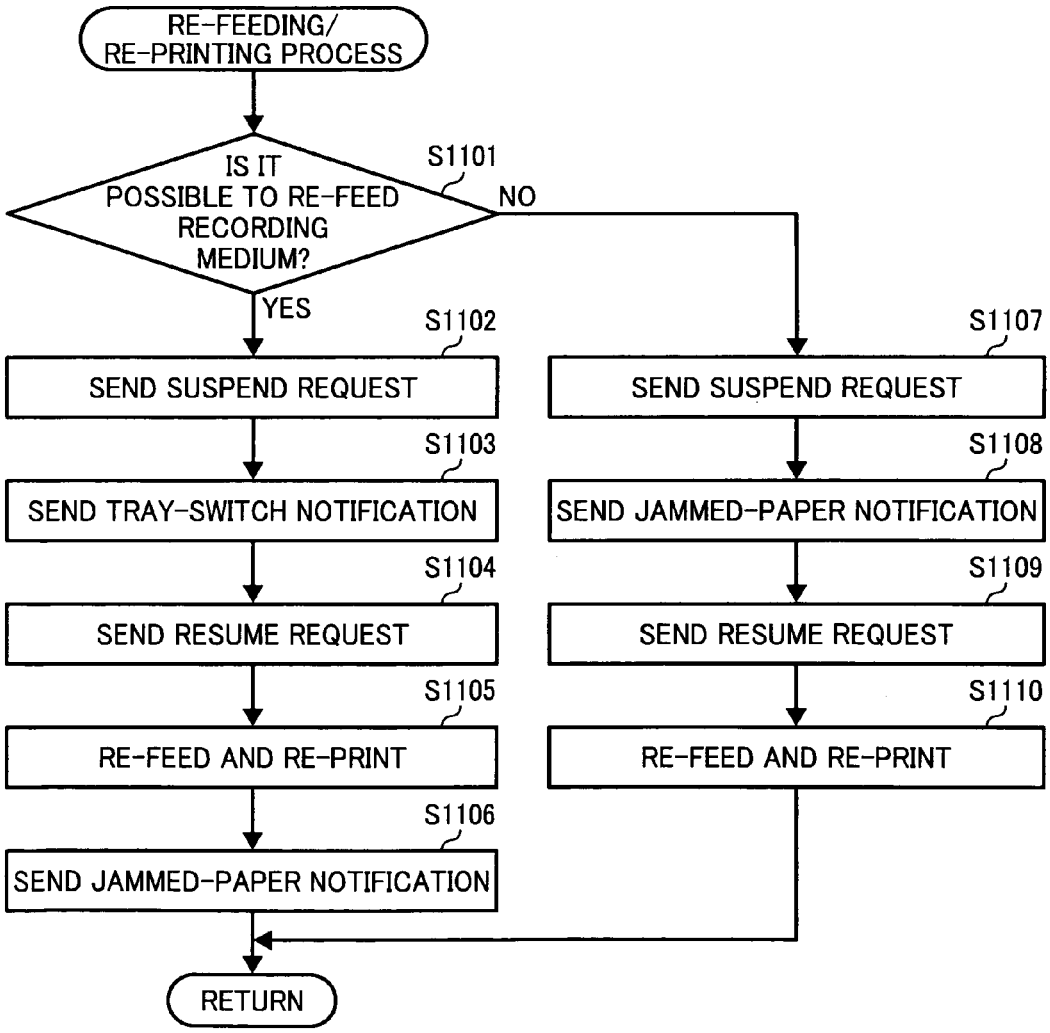
FIG. 13 is a detailed flowchart of a re-feeding/re-printing process shown in FIG. 10 according to the first embodiment.

FIG. 13 is a detailed flowchart of the re-feeding/re-printing process shown in FIG. 10. The re-feeding/re-printing process includes two streams derived from Step S1101 of determining whether it is possible to re-feed the recording medium.

If the re-feed determining unit 303 determines that it is possible to re-feed the recording medium (Yes at Step S1101), the re-feed determining unit 303 sends a suspend request to the controller 2 to suspend the feeding operation due to the paper jam (Step S1102). The re-feed determining unit 303 sends identification data about the top page from among pages suspended due to the paper jam (hereinafter, "suspended top-page ID") to the controller 2 attached with the suspend request.

The re-feed determining unit 303 sends a tray-switch notification to the controller 2 to notify that the feed tray from which the recording medium is to be fed is switched to the re-feed tray, without waiting until the feeding operation resumes (Step S1103). After that, the re-feed determining unit 303 sends a resume request to the controller 2 to resume the feeding operation (Step S1104).

Upon receiving the resume request, the controller 2 re-sends data to be printed on the suspended pages by referring to the received suspended top-page ID to the engine 3, and starts re-printing (Step S1105). When all pages have been printed, the re-feed determining unit 303 sends a jammed-paper notification to the controller 2 to request the user to remove the jammed paper from the jammed path (Step S1106). Upon receiving the jammed-paper notification from the engine 3 after all pages have been printed, the controller 2 recognizes that paper in the feed path as the jammed paper and does not perform the recovery process any more, i.e., the suspended pages are not printed twice. A paper-jam status is maintained until the series of user operations has been completed which includes the user opens a cover of the feed unit, removes the jammed paper from the jamming feed tray, and closes the cover.

If the re-feed determining unit 303 determines that it is impossible to re-feed the recording medium (No at Step S1101), the re-feed determining unit 303 sends the suspend request and the suspended top-page ID to the controller 2 (Step S1107). The re-feed determining unit 303 sends the jammed-paper notification to the controller 2 (Step S1108).

When the jammed paper is removed from the laser printer 1 and the paper-jam status is released, the re-feed determining unit 303 sends the resume request to the controller 2 (Step S1109). Upon receiving the resume request, the controller 2 re-sends data to be printed on the suspended pages by referring to the received suspended top-page ID to the engine 3, and starts re-printing (Step S1110).

If it is possible to re-feed the recording medium, the laser printer 1 can continue printing by switching the feed tray from which the recording medium is to be fed to the re-feed tray. Therefore, the laser printer 1 continues printing with the recovery process of sending the tray-switch notification after the suspend request and before the resume request. On the other hand, if it is impossible to re-feed the recording medium, the laser printer 1 cannot continue printing until the jammed paper is removed. Therefore, the laser printer performs the conventional recovery process of sending the suspend request, the jammed-paper notification, and the resume request in this order, re-feeding the recording medium, and re-printing the suspended pages.

In this manner, when a paper jam has occurred, the laser printer 1 determines whether it is possible to re-feed the recording medium from another feed unit instead of the jamming feed unit, and perform, if it is possible to re-feed the recording medium, the time-efficient recovery process. This shortens the printing time in an event of a paper jam, and thereby improves the productivity.

Moreover, the re-feed determining process can be skipped depending on the usage environment or the usage conditions, which ensures higher usability.

Furthermore, the laser printer stores data about performances of each feed unit such as the jam frequency and the number of paper jams in the nonvolatile memory. This makes it possible to select the appropriate re-feed tray depending on its performance.

Moreover, the laser printer stores in the nonvolatile memory the number of recording media that have been fed from the feed tray. This makes it possible to select the appropriate re-feed tray depending on its frequency of usage.

Furthermore, it is possible to select a reliable feed unit as the re-feed tray by referring to the number of paper jams stored in the nonvolatile memory. This makes it possible to decrease frequency of miss-feeding.

Moreover, because the feed units having the common feed-path structure (common layout with respect to the rollers and the sensors) are used, the feed units can be replaced with each other. This increases a degree of freedom in arrangement of the feed units, which increases the versatility while reducing the manufacture costs.

Furthermore, the jammed-paper notification is sent to the controller after the laser printer performs the recovery process and then finally completes the print job. As a result, the laser printer requests the user to remove the jammed paper after all pages has been printed.

In the laser printer according to the first embodiment, upon receiving the suspend request and the resume request from the engine in this order, the controller suspends the feeding operation of the engine and stops printing, and then resumes the feeding operation and prints the suspended pages. In other words, if it is possible to re-feed the recording medium, the engine sends the suspend request, the tray-switch notification, and the resume request to the controller. After re-feeding and re-printing in response to those requests and notification, the engine sends the jammed-paper notification to the controller.

On the contrary, in a laser printer according to a second embodiment of the present invention, upon receiving the suspend request, a controller suspends a feeding operation of an engine. However, upon receiving the resume request, the controller sends data about all pages to the engine including pages that has been printed before the paper jam occurs, and prints all pages. In other words, once the suspend request is sent to the controller, the laser printer has to print all pages from the top after the printing operation is resumed even if it is possible to re-feed the recording medium. In the laser printer according to the second embodiment, if it is possible to re-feed the recording medium, the re-feeding/re-printing are performed without sending the suspend request, the tray-switch notification, and the resume request to the controller. When the re-feeding/re-printing has been completed, the engine sends the jammed-paper notification to the controller.

Figure 14:
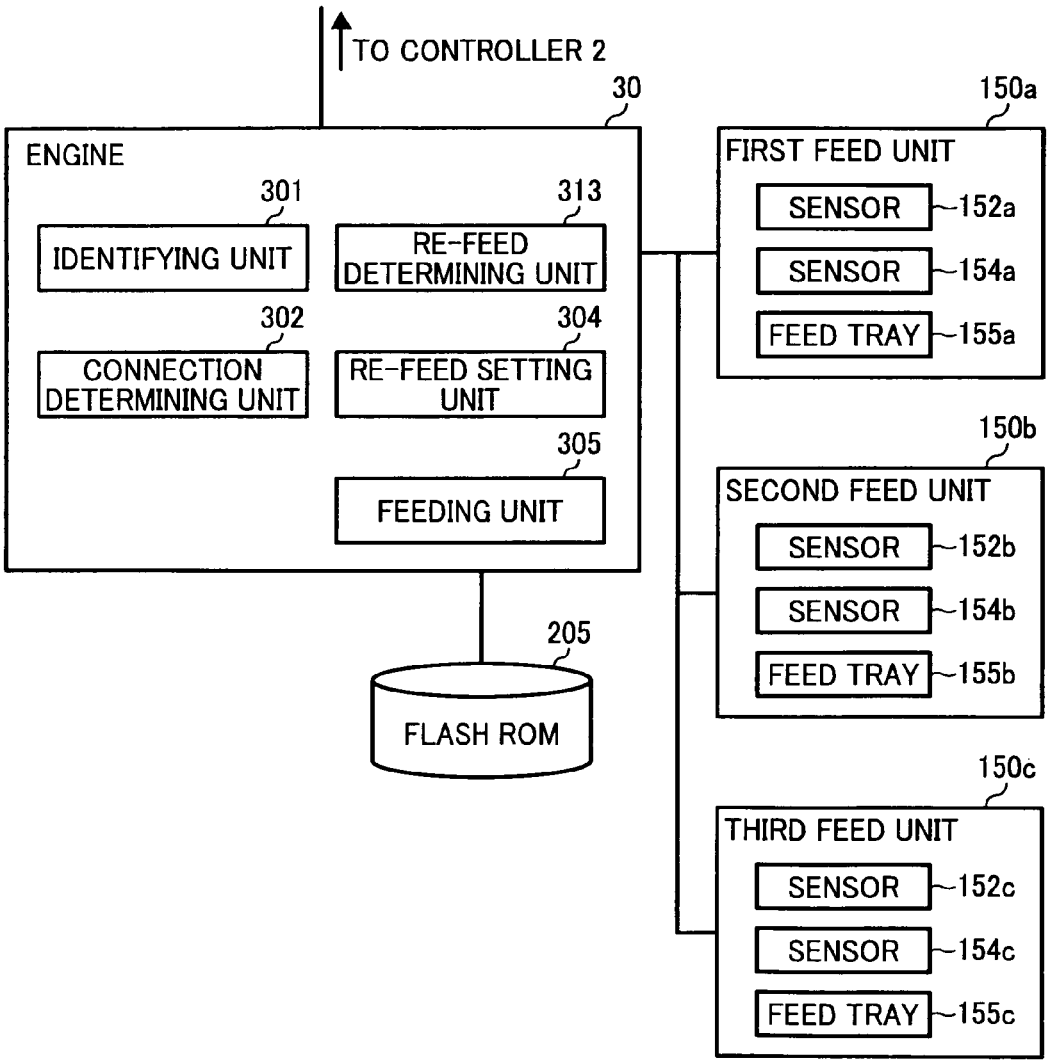
FIG. 14 is a functional diagram of an engine according to a second embodiment of the present invention.

The laser printer and the feed unit according to the second embodiment have the same structure as the laser printer 1 and the feed unit 150 according to the first embodiment except that the controller operates in the above-described manner. Parts corresponding to those in the first embodiment are denoted with the same reference numerals, and the same description is not repeated. FIG. 14 is a functional diagram of an engine 30 according to the second embodiment.

The engine 30 includes the identifying unit 301, the connection determining unit 302, a re-feed determining unit 313, the re-feed setting unit 304, and the feeding unit 305. The engine 30 is connected to the flash ROM 205, the first feed unit 150*a*, the second feed unit 150*b*, and the third feed unit 150*c*.

When the paper jam has occurred, the jammed path and the jamming feed tray are identified. When all pages are printed on the recording medium conveyed from the re-feed tray, the re-feed determining unit 313 sends a jammed-paper notification to the controller 2 to request the user to remove the jammed paper. Upon receiving the jammed-paper notification, the controller 2 performs the predetermined action such as displaying a message requesting the user to remove the jammed paper on the operation panel 5. The re-feed determining unit 313 performs the re-feed determining process in the same manner as in the first embodiment.

Figure 15:
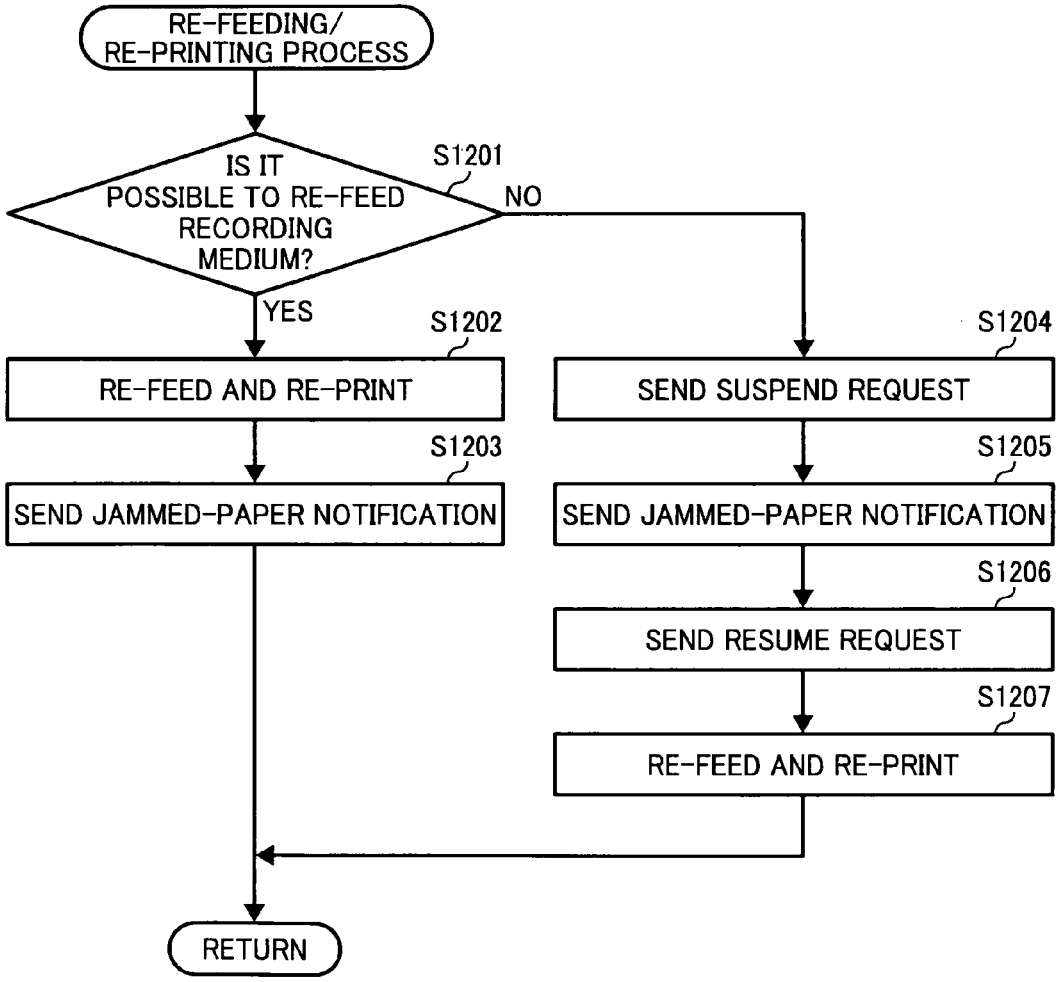
FIG. 15 is a detailed flowchart of a re-feeding/re-printing process according to the second embodiment.

FIG. 15 is a detailed flowchart of a re-feeding/re-printing process according to the second embodiment. The re-feeding/re-printing process includes two streams derived from Step S1201 of determining whether it is possible to re-feed the recording medium. The main process, the interruption process, the recovery process, and the re-feed determining process are performed in the same manner as in the first embodiment. The explanation about those processes is not repeated (see FIGS. 8 to 12).

If the re-feed determining unit 313 determines that it is possible to re-feed the recording medium (Yes at Step S1201), the feeding unit 305 re-feeds the recording medium and the printing operation is continued (Yes at S1202). It is noted that the feeding/printing operation of the engine 3 is not suspended because the re-feed determining unit 313 does not send the suspend request to the controller 2.

When all pages are printed, the re-feed determining unit 313 sends the jammed-paper notification to the controller 2 to request the user to remove the jammed paper from the jammed path (Step S1203). Upon receiving the jammed-paper notification from the engine 3 after all pages have been printed, the controller 2 recognizes that paper in the feed path as the jammed paper and does not perform the recovery process any more, i.e., the suspended pages are not printed twice. The paper-jam status is maintained until the series of user operations has been completed which includes the user opens a cover of the feed unit, removes the jammed paper from the jamming feed tray, and closes the cover.

If the re-feed determining unit 313 determines that it is impossible to re-feed the recording medium (No at Step S1201), Steps S1204 to S1207 are performed. Because Steps S1204 to S1207 are similar to Steps S1107 to S1110 shown in FIG. 13, the explanation about those steps is omitted.

In this manner, if it is determined that it is possible to re-feed the recording medium, the laser printer according to the second embodiment continues feeding and printing without the suspend request, the tray-switch notification, and the resume request being sent from the engine to the controller. When all pages are printed, the engine sends the jammed-paper notification to the controller. The controller does not suspend the printing operation because the controller does not receive the suspend request. Moreover, if it is determined that it is possible to re-feed the recording medium, pages that has already been printed before the paper jam are not printed twice. As a result, it is possible to save outputting of the useless copies, which improves the productivity while reducing the manufacture costs.

When a paper jam has occurred, the re-feed determining unit according to either the first embodiment or the second embodiment determines whether it is possible to re-feed the recording medium by determining whether the laser printer is connected to a feed unit including a feed tray other than the jamming feed tray, and then determining the position of the jammed path (see Steps S903 to S905 shown in FIG. 11). However, it is allowable to replace the order of those determinations with each other. More particularly, the re-feed determining unit determines whether it is possible to re-feed the recording medium by determining the position of the jammed path, and then determining whether the laser printer is connected to a feed unit including a feed tray other than the jamming feed tray.

The re-feed determining unit according to either the first embodiment or the second embodiment determines whether it is possible to re-feed the recording medium from a feed tray on which the recording medium having the same size is stacked instead of the jamming feed tray. However, the re-feed tray is not limited to the feed tray having the same-size recording medium. For example, the re-feed determining unit can be configured to determine, regardless of the size of the recording medium, whether it is possible to re-feed the recording medium from a feed tray instead of the jamming feed tray. If the recording medium of the feed tray is larger than that of the jamming feed tray, the re-feed determining unit determines that it is possible to re-feed the recording medium because the images can be printed on the larger recording medium.

Moreover, the re-feed determining unit can be configured to determine whether it is possible to re-feed the recording medium from a feed tray on which the recording medium having the same size and the same orientation as the recording medium of the jamming feed tray is stacked instead of the jamming feed tray. Assume that one recording medium is placed on one feed tray in the portrait orientation and another recording medium is placed on another feed tray in the portrait orientation. In this case, the two recording media have the same orientation.

Furthermore, the re-feed determining unit can be configured to determine whether it is possible to re-feed the recording medium from a feed tray on which the recording medium having the same orientation is stacked instead of the jamming feed tray with regardless of the size of the recording medium. If the recording medium of the feed tray is larger than that of the jamming feed tray and has the same orientation, the re-feed determining unit determines that it is possible to re-feed the recording medium because the images can be printed on the larger recording medium. For example, an image for an A4 sheet can be printed on a B4 sheet having the same orientation.

Figure 16:
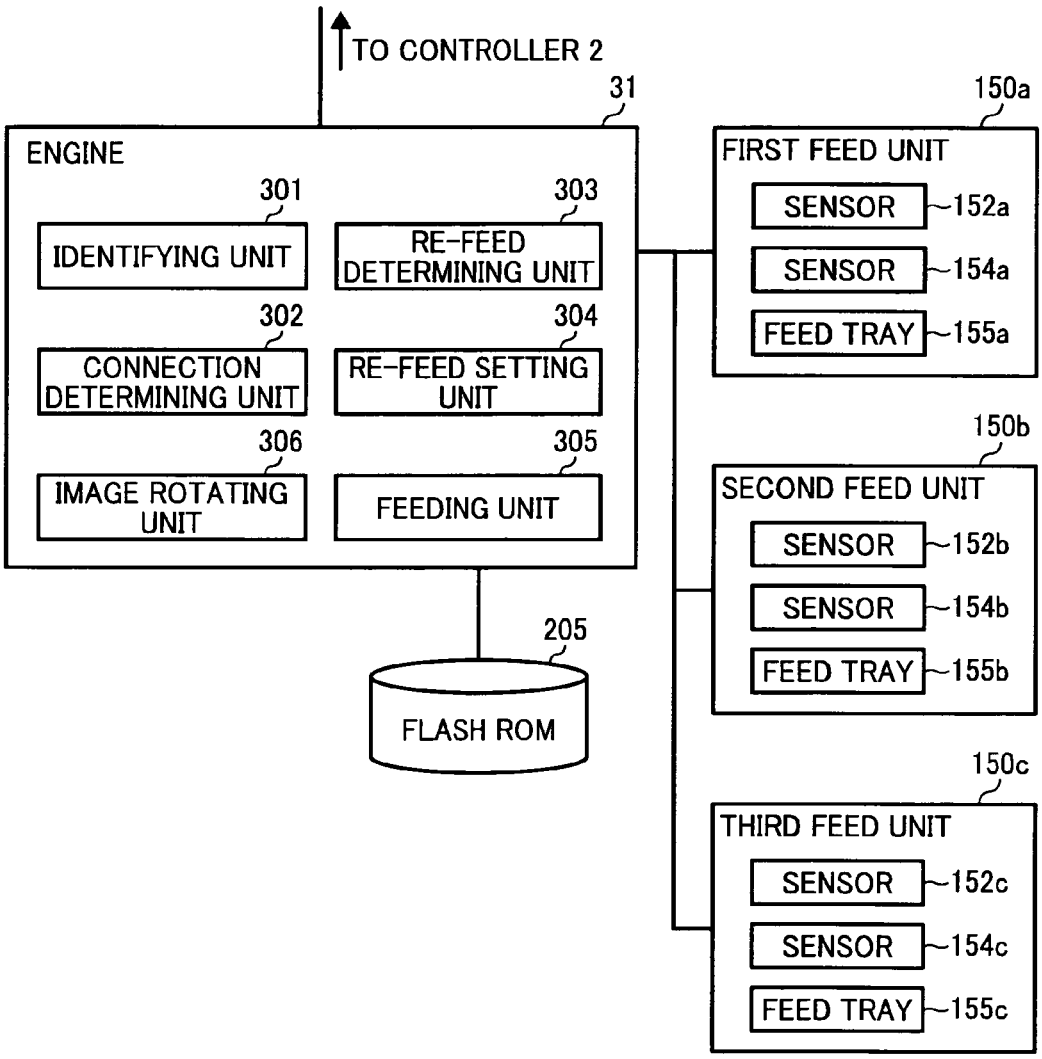
FIG. 16 is a functional diagram of an engine according to a third embodiment of the present invention.

The re-feed determining unit according to either the first embodiment or the second embodiment determines whether it is possible to re-feed the recording medium from a feed tray on which the recording medium having the same size is stacked instead of the jamming feed tray. If the recording medium of the re-feed tray has the same orientation as the recording medium of the jamming feed tray, it is possible to re-feed the recording medium from the re-feed tray and print the images on the recording medium. However, if the recording medium of the re-feed tray has the different orientation, it is necessary to rotate images so that full images can be printed on the recording medium. As shown in FIG. 16, an engine 31 according to a third embodiment of the present invention includes an image rotating unit 306. If the recording medium of the re-feed tray has the different orientation, the image rotating unit 306 rotates an image to be printed by 90 degrees by using, for example, a conventional technology disclosed in Japanese Patent Application Laid-open No. 2004-242212.

According to an aspect of the present invention, it is possible to improve productivity of an image forming apparatus by performing, in an event of a paper jam, a time-efficient recovery process that takes advantage of multiple feed trays.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus connectable to a plurality of recording medium feed trays including a first feed tray and a second feed tray, the image forming apparatus comprising:

an image forming unit that forms an image on a recording medium conveyed from one of the feed trays;

a feed path that connects a corresponding feed tray of the feed trays to the image forming unit, the feed path including a first feed path that connects the first feed tray to the image forming unit and a second feed path that connects the second feed tray to the image forming unit;

a detecting unit provided on the feed path to sense recording medium jam in the feed path, the detecting unit including a first detecting unit that senses recording medium jam in the first feed path and a second detecting unit that senses recording medium jam in the second feed path;

an identifying unit that identifies a feed path and a feed tray where recording medium jam has occurred as a jammed path and a jamming feed tray from information from the detecting unit;

a first determining unit that determines whether the image forming apparatus is connected to a non jamming feed tray, that is any feed tray other than the jamming feed tray;

a second determining unit that determines, when the first determining unit determines that the image forming apparatus is connected to the non jamming feed tray, whether the non jamming feed tray can feed a recording medium to the image forming unit based on the jammed path that is identified by the identifying unit;

a feeding unit that feeds, when the second determining unit determines that the non jamming feed tray can feed a recording medium, a recording medium from the non jamming feed tray to the image forming unit; and a controller that controls feeding operation of the feeding unit, wherein the feed path includes an individual path that is directly connected to the corresponding feed tray, through which only a recording medium coming from the corresponding feed tray can pass; and a common path that connects the individual path to the image forming unit, through which not only a recording medium coming from the corresponding feed tray but also a recording medium coming from another feed tray can pass, the detecting unit includes an individual-path detecting unit provided on the individual path to sense recording medium jam in the individual path, the individual-path detecting unit including a first individual-path detecting unit that senses recording medium jam in the individual path of the first feed path and a second individual-path detecting unit that senses recording medium jam in the individual path of the second feed path; and a common-path detecting unit provided on the common path to sense recording medium jam in the common path, the common-path detecting unit including a first common-path detecting unit that senses recording medium jam in the common path of the first feed path and a second common-path detecting unit that senses recording medium jam in the common path of the second feed path, the identifying unit identifies either an individual feed path or a common path and a feed tray where recording medium jam has occurred as the jammed path and the jamming feed tray from information from either the individual-path detecting unit or the common-path detecting unit, and when the following three conditions are met, (i) the first determining unit determines that the image forming apparatus is connected to the non jamming feed tray, (ii) the identifying unit identifies the common path as the jammed path and (iii) a recording medium fed from the non jamming feed tray to the image forming unit passes only the common path located downstream of the identified common path, the second determining unit determines that the non jamming feed tray can feed a recording medium to the image forming unit, the second determining unit sends a jammed-paper notification to the controller to prompt the removal of the jammed recording medium from the jammed path only after the identifying unit identifies the jammed path and the jamming feed tray and printing on a recording medium fed from the non jamming feed tray is completed.

2. The image forming apparatus according to claim 1, wherein the first determining unit determines that the image forming apparatus is connected to the non jamming feed tray when a recording medium having same size as a recording medium of the jamming feed tray is stacked on the non jamming feed tray.

3. The image forming apparatus according to claim 1, wherein the first determining unit determines that the image forming apparatus is connected to the non jamming feed tray when a recording medium having same orientation as a recording medium of the jamming feed tray is stacked on the non jamming feed tray.

4. The image forming apparatus according to claim 1, wherein, when the first determining unit determines that the image forming apparatus is connected to the non jamming feed tray and the identifying unit identifies the individual path as the jammed path, the second determining unit determines that the non jamming feed tray can feed a recording medium to the image forming unit.

5. The image forming apparatus according to claim 1, wherein upon determining that the non jamming feed tray can feed a recording medium to the image forming unit, the second determining unit sends to the controller a suspend request to suspend the feeding operation due to a jam, a tray-switch notification to notify that a feed tray from which a recording medium is to be fed is switched to the non jamming feed tray, and a resume request to resume the feeding operation, upon receiving the suspend request from the second identifying unit, the controller causes the feeding unit to suspend the feeding operation, and upon receiving the resume request from the second identifying unit, the controller causes the feeding unit to resume the feeding operation.

6. The image forming apparatus according to claim 5, wherein when re-printing operation has been completed as a result of re-feeding from the non-jamming feed tray in response to the resume request, the second determining unit sends a jammed-paper notification to the controller to request a user to remove the jammed recording medium from the jammed path.

7. The image forming apparatus according to claim 1, further comprising a storage unit that stores therein number of jams and identification data of each feed tray in a correspondence manner, wherein the first determining unit determining whether the non jamming feed tray includes a plurality of feed trays;

when the first determining unit determining that the non jamming feed tray includes a plurality of feed trays, the second determining unit selects a feed tray having lowest number of jams from among the feed trays as a re-feed tray by referring to the storage unit, and determines that the re-feed tray can feed a recording medium to the image forming unit.

8. The image forming apparatus according to claim 7, wherein the storage unit further includes number of recording media that have been fed and identification data of each feed tray in a correspondence manner, and when the first determining unit determining that the non jamming feed tray includes a plurality of feed trays, the second determining unit selects a feed tray having lowest jam frequency from among the feed trays as a re-feed tray by referring to the storage unit, and determines that the re-feed tray can feed a recording medium to the image forming unit, the jam frequency being calculated from the number of jams and the number of recording media that have been fed.

9. The image forming apparatus according to claim 1, further comprising a re-feed setting unit that receives a setting command from a user, wherein when the re-feed setting unit receives the setting command from the user, the feeding unit feeds a recording medium from the non jamming feed tray to the image forming unit.

10. An image forming system including an image forming apparatus and a plurality of recording medium feed trays connected to the image forming apparatus, the recording medium feed trays including a first feed tray and a second feed tray, the image forming system comprising:

an image forming unit that forms an image on a recording medium conveyed from one of the feed trays;

a feed path that connects a corresponding feed tray of the feed trays to the image forming unit, the feed path including a first feed path that connects the first feed tray to the image forming unit and a second feed path that connects the second feed tray to the image forming unit;

a detecting unit provided on the feed path to sense recording medium jam in the feed path, the detecting unit including a first detecting unit that senses recording medium jam in the first feed path and a second detecting unit that senses recording medium jam in the second feed path;

an identifying unit that identifies a feed path and a feed tray where recording medium jam has occurred as a jammed path and a jamming feed tray from information from the detecting unit;

a first determining unit that determines whether the image forming apparatus is connected to a non jamming feed tray, that is any feed tray other than the jamming feed tray;

a second determining unit that determines, when the first determining unit determines that the image forming apparatus is connected to the non jamming feed tray, whether the non jamming feed tray can feed a recording medium to the image forming unit based on the jammed path that is identified by the identifying unit;

a feeding unit that feeds, when the second determining unit determines that the non jamming feed tray can feed a recording medium, feeds a recording medium from the non jamming feed tray to the image forming unit; and a controller that controls feeding operation of the feeding unit, wherein the feed path includes an individual path that is directly connected to the corresponding feed tray, through which only a recording medium coming from the corresponding feed tray can pass; and a common path that connects the individual path to the image forming unit, through which not only a recording medium coming from the corresponding feed tray but also a recording medium coming from another feed tray can pass, the detecting unit includes an individual-path detecting unit provided on the individual path to sense recording medium jam in the individual path, the individual-path detecting unit including a first individual-path detecting unit that senses recording medium jam in the individual path of the first feed path and a second individual-path detecting unit that senses recording medium jam in the individual path of the second feed path; and a common-path detecting unit provided on the common path to sense recording medium jam in the common path, the common-path detecting unit including a first common-path detecting unit that senses recording medium jam in the common path of the first feed path and a second common-path detecting unit that senses recording medium jam in the common path of the second feed path, the identifying unit identifies either an individual feed path or a common path and a feed tray where recording medium jam has occurred as the jammed path and the jamming feed tray from information from either the individual-path detecting unit or the common-path detecting unit, and when the following three conditions are met, (i) the first determining unit determines that the image forming apparatus is connected to the non jamming feed tray, (ii) the identifying unit identifies the common path as the jammed path and (iii) a recording medium fed from the non jamming feed tray to the image forming unit passes only the common path located downstream of the identified common path, the second determining unit determines that the non jamming feed tray can feed a recording medium to the image forming unit, the second determining unit sends a jammed-paper notification to the controller to prompt the removal of the jammed recording medium from the jammed path only after the identifying unit identifies the jammed path and the jamming feed tray and printing on a recording medium fed from the non jamming feed tray is completed.

11. An image forming method implemented on an image forming apparatus connectable to a plurality of recording medium feed trays, the recording medium feed trays including a first feed tray and a second feed tray, and the image forming apparatus including an image forming unit that forms an image on a recording medium conveyed from one of the feed trays;

a feed path that connects a corresponding feed tray of the feed trays to the image forming unit, the feed path including a first feed path that connects the first feed tray to the image forming unit and a second feed path that connects the second feed tray to the image forming unit; and a detecting unit provided on the feed path to sense recording medium jam in the feed path, the detecting unit including a first detecting unit that senses recording medium jam in the first feed path and a second detecting unit that senses recording medium jam in the second feed path, the image forming method comprising:

identifying a feed path and a feed tray where recording medium jam has occurred as a jammed path and a jamming feed tray from information from the detecting unit;

first determining including determining whether the image forming apparatus is connected to a non jamming feed tray, that is any feed tray other than the jamming feed tray;

second determining including determining, when it is determined at the first determining that the image forming apparatus is connected to the non jamming feed tray, whether the non jamming feed tray can feed a recording medium to the image forming unit based on the jammed path that is identified by the identifying unit; and feeding, when it is determined at the second determining that the non jamming feed tray can feed a recording medium, a recording medium from the non jamming feed tray to the image forming unit; and a controller that controls feeding operation of the feeding unit, wherein the feed path includes an individual path that is directly connected to the corresponding feed tray, through which only a recording medium coming from the corresponding feed tray can pass; and a common path that connects the individual path to the image forming unit, through which not only a recording medium coming from the corresponding feed tray but also a recording medium coming from another feed tray can pass, the detecting unit includes an individual-path detecting unit provided on the individual path to sense recording medium jam in the individual path, the individual-path detecting unit including a first individual-path detecting unit that senses recording medium jam in the individual path of the first feed path and a second individual-path detecting unit that senses recording medium jam in the individual path of the second feed path; and a common-path detecting unit provided on the common path to sense recording medium jam in the common path, the common-path detecting unit including a first common-path detecting unit that senses recording medium jam in the common path of the first feed path and a second common-path detecting unit that senses recording medium jam in the common path of the second feed path, the identifying unit identifies either an individual feed path or a common path and a feed tray where recording medium jam has occurred as the jammed path and the jamming feed tray from information from either the individual-path detecting unit or the common-path detecting unit, and when the following three conditions are met, (i) the first determining unit determines that the image forming apparatus is connected to the non jamming feed tray, (ii) the identifying unit identifies the common path as the jammed path and (iii) a recording medium fed from the non jamming feed tray to the image forming unit passes only the common path located downstream of the identified common path, the second determining unit determines that the non jamming feed tray can feed a recording medium to the image forming unit, the second determining unit sends a jammed-paper notification to the controller to prompt the removal of the jammed recording medium from the jammed path only after the identifying unit identifies the jammed path and the jamming feed tray and printing on a recording medium fed from the non jamming feed tray is completed.

* * * * *